US006394887B1

(12) United States Patent
Edinger

(10) Patent No.: US 6,394,887 B1
(45) Date of Patent: May 28, 2002

(54) APPARATUS FOR USE WITH AUTOMATED ABRADING EQUIPMENT

(76) Inventor: Stillman Eugene Edinger, 87730 Oak Island Dr., Veneta, OR (US) 97487

( * ) Notice: Subject to any disclaimer, the term of this patent is extended or adjusted under 35 U.S.C. 154(b) by 0 days.

(21) Appl. No.: 09/552,282

(22) Filed: Apr. 19, 2000

Related U.S. Application Data

(60) Provisional application No. 60/130,402, filed on Apr. 19, 1999.

(51) Int. Cl.[7] ..... B24B 23/02
(52) U.S. Cl. ..... 451/494; 451/490
(58) Field of Search ..... 451/490, 494, 451/538, 511, 523, 524

(56) References Cited

U.S. PATENT DOCUMENTS

| | | | | | |
|---|---|---|---|---|---|
| 3,226,888 | A | * | 1/1966 | Erenyi | 451/494 |
| 3,346,904 | A | * | 10/1967 | Armstrong | 451/490 |
| 3,522,681 | A | * | 8/1970 | Lampert | 451/490 |
| 3,703,739 | A | * | 11/1972 | Young et al. | 451/538 |
| 3,875,703 | A | * | 4/1975 | Clemente | 451/538 |
| 4,222,204 | A | * | 9/1980 | Benner | 451/494 |
| 4,617,767 | A | * | 10/1986 | Ali | 451/490 |
| 4,667,447 | A | * | 5/1987 | Barton | 451/494 |
| 5,201,785 | A | | 4/1993 | Nagano | |
| 5,297,366 | A | | 3/1994 | Huddleston | |
| 5,692,949 | A | | 12/1997 | Sheffield et al. | |
| 5,725,423 | A | | 3/1998 | Barry et al. | |
| 6,089,963 | A | * | 7/2000 | Wiand et al. | 451/494 |

FOREIGN PATENT DOCUMENTS

| | | | | |
|---|---|---|---|---|
| EP | 0112405 | * | 7/1984 | 451/490 |

* cited by examiner

*Primary Examiner*—Robert A. Rose
(74) *Attorney, Agent, or Firm*—Steven J. Adamson

(57) ABSTRACT

An adapter for use with automated abrading equipment. The adapter includes a first surface for the releasable mounting of abrasive articles, such as those mounted with releasable adhesive, and a second surface for releasable mounting to automated equipment. The second surface may contain hook and/or loop like structures or other non-adhesive based mounting mechanisms, and the adapter may include magnetic material.

24 Claims, 2 Drawing Sheets

APPARATUS FOR USE WITH AUTOMATED ABRADING EQUIPMENT

CROSS REFERENCE TO RELATED APPLICATIONS

This application claims the benefit of U.S. Provisional Application No. 60/130,402, filed Apr. 19, 1999, and having the same title and inventor(s) as above.

FIELD OF THE INVENTION

The present invention relates to automated abrading equipment and abrasive articles therefor.

BACKGROUND OF THE INVENTION

FIG. 1 illustrates one prior art automated abrading arrangement. A drill or other automated device 10 is provided and a pad 12 is mounted into the chuck of the drill. A releasable fastening surface is provided on the exterior face 11 of the pad to permit releasable fastening of an abrasive article 14, such as a sanding or buffing disc, etc.

Conventional releasable attachment techniques for abrasive articles include both releasable adhesive and hook and loop, e.g., Velcro®, arrangements. Abrasive articles that are attached with releasable adhesive typically have one face 15 on which the abrasive material is provided and another face 13 on which the releasable adhesive is provided. When in use, for example, in an auto body shop, a repair person must use many discs of different abrasive grades, using a coarser grade first and then switching to finer grades. The abrasive articles (e.g., sandpaper discs) having different grades are often laid (adhesive side up) on the floor about a repair person so that the repair person can readily switch between them. In this scenario, the abrasive article tends to become fouled by people stepping on the exposed adhesive side and the settling out of dust or other debris from the sanding or buffing operations. These and related types of fouling cause the adhesive material to cease functioning properly before the abrasive material on the other side is spent.

Abrasive articles with hook or loop backing, on the other hand, do not foul as readily as those backed with adhesive material. Hook or loop backed abrasive articles, however, tend to cost significantly more than adhesive backed articles. For example, approximate current prices for adhesive backed sanding discs and hook and loop backed sanding discs are $0.17 and $0.88, respectively.

SUMMARY OF THE INVENTION

Accordingly, it is an object of the present invention to provide an adapter that when used with an abrasive article provides both reduced cost abrading and is slow to foul.

It is another object of the present invention to provide an adapter that adapts between hook or loop or other non-adhesive releasable attachment on a first surface and releasable adhesive based attachment on a second surface.

It is also an object of the present invention to provide an adapter that has magnetic properties and can be readily maintained away from fouling sources or otherwise arranged for ready use.

These and related objects of the present invention are achieved by an apparatus for use with automated abrading equipment as described herein.

In one embodiment, the present invention includes an adapter that on one side permits adhesive mounting of an abrasive article and on the other side permits non-adhesive mounting to automated abrading equipment. The adapter may include magnetic material and the non-adhesive mounting surface may contain hook and/or loop like structures. Both hook and loop like structures may be provided in adjacent and preferably balanced sections to permit use with either a hook or loop based pad.

The attainment of the foregoing and related advantages and features of the invention should be more readily apparent to those skilled in the art, after review of the following more detailed description of the invention taken together with the drawings.

DETAILED DESCRIPTION

Figure 1:
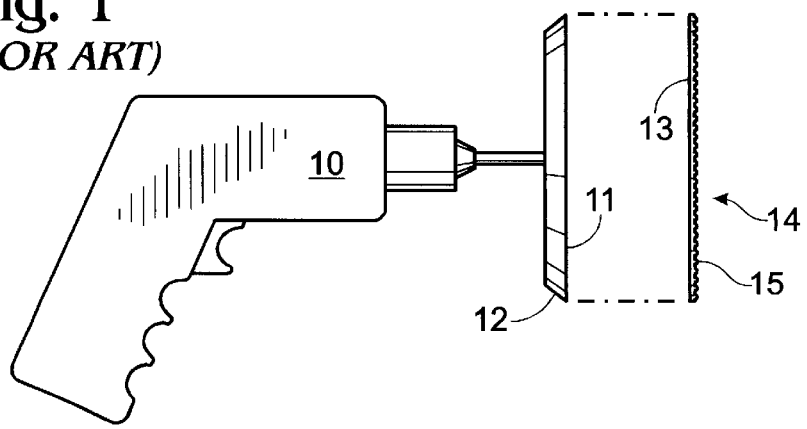
Fig. 1 (PRIOR ART)
FIG. 1 is a side view of a representative prior art automated abrading arrangement.
Figure 2:
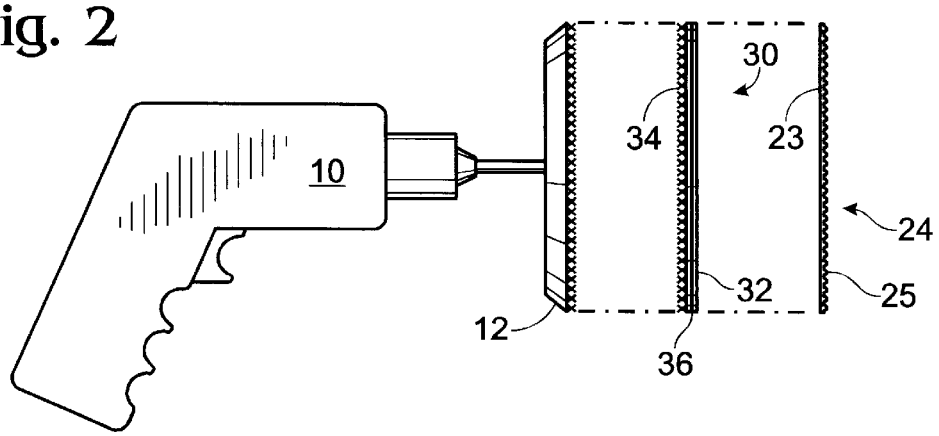
FIG. 2 is a side view of an automated abrading arrangement in accordance with the present invention.

Referring to FIG. 2, a side view of an automated abrading arrangement in accordance with the present invention is shown. The arrangement of FIG. 2 includes the drill 10 and pad 12 (that distributes the rotating force of the drill) of FIG. 1. FIG. 2 also includes an abrasive article 24, but in contrast to abrasive article 14 of FIG. 1 which has adhesive or hook or loop backing, abrasive article 24 preferably has adhesive backing on face 23 (and abrasive material on face 25).

The present invention provides an adapter 30 that is preferably provided between pad 12 and an abrasive article or disc 24. Adapter 30 preferably has a face 32 (disposed towards disc 24 in FIG. 2) that is configured for attachment of an adhesive material backed abrasive article. Adhesive mounting face 32 may be formed of a plastic such as acrylic or of a fabric such as cloth fabric or of any other suitable material. Several substrates on which adhesive backed articles are mounted are known in the art.

The other face 34 of adapter 30 preferably has a hook or loop material or other releaseably attached material that is less easily fouled than adhesive material. If loop material is provided on face 34 then hook material is preferably provided on the pad exterior surface 11. If hook material is provided on face 34 then loop material is preferably provided on the pad exterior surface 11. The present invention also includes providing both hook and loop portions on face 34 as discussed in more detail below with respect to FIGS. 8 and 9.

In use, article 24 is mounted to adapter 30 and adapter 30 is mounted to pad 12. To accommodate the workplace scenario described in the Background of the Invention section, several abrasive articles 24 of varying coarseness are coupled to an equal number of adapters. The adapters and adhesive backed articles, i.e., abrasive "units", can be laid about a repair person who can readily switch between units with different abrasiveness grades. When the abrasiveness of the article wears out, that article is peeled off and replaced. Using these abrasive units, the hook or loop surface (as opposed to the adhesive surface) is exposed and hence the unit does not foul as readily.

In a further embodiment of the present invention, magnetic material 36 is provided within or on adapter 30. This magnetic material permits the adapter (and abrasive article attached thereto) to be temporarily mounted on any suitable metallic surface. Hence, when a repair person is working on an automobile, the repair person may temporarily mount the abrasive units of varying coarseness directly on metallic parts of the vehicle, for example, the panel on which the repair person is working. If the panel or other part of the automobile body is made of fiberglass or another non-metallic material, a metal bar or the like can be mounted with suction cups and the abrasive units can be mounted to the metal bar.

Figure 3:
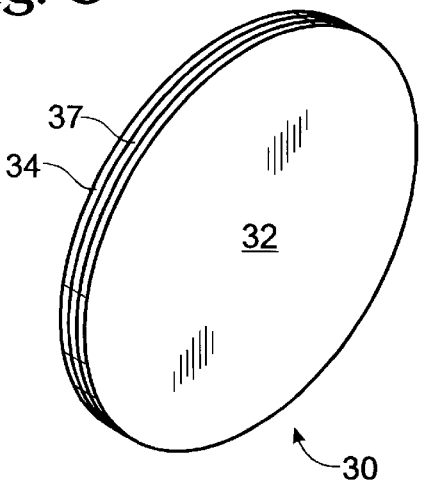
FIG. 3 is a perspective view of an adapter in accordance with the present invention.

Referring to FIG. 3, a perspective view of adapter 30 in accordance with the present invention is shown. The thickness of the adapter is exaggerated in FIG. 3 to illustrate the potential layers of the adapter. FIG. 3 illustrates face 32 that receives an adhesive backed article. FIG. 3 also illustrates a portion (side portion) of hook or loop or like material face 34 and a core 37 that may optionally be provided between the materials of faces 32 and 34. This core material may include magnetic material and/or material that provides rigidity, durability and/or better adhesion between the materials of faces 32 and 34, etc. If magnetic material is provided in core 37, the magnetic material is preferably formed from a flexible sheet magnet.

Figure 4:
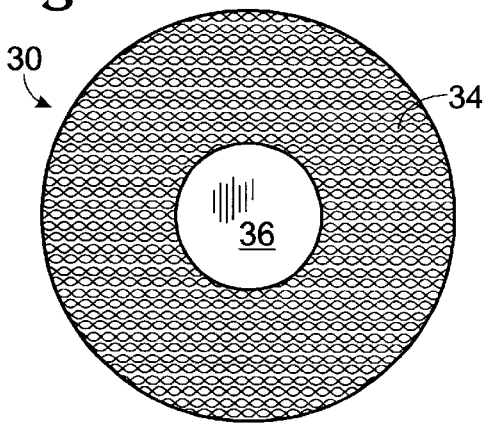
FIGS. 4–5 are plan views of two embodiments of an adapter with magnetic material provided therewith in accordance with the present invention.
Figure 5:
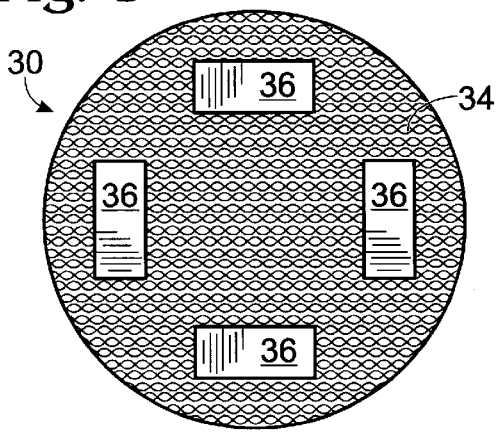

Referring to FIGS. 4–5, two embodiments of adapter 30 with magnetic material 36 provided therewith in accordance with the present invention are shown. As opposed to providing magnetic material between the adhesive face 32 and the hook or loop or like face 34, the magnetic material may be provided, for example, in one of the faces 32, 34. FIGS. 4 and 5 show two embodiments of magnetic material being provided in the hook or loop face. FIG. 4 illustrates a centrally disposed magnet while FIG. 5 illustrates a plurality of smaller magnets disposed about face 34. These structures can be formed by removal of a portion of the hook or loop face and replacing that portion (or portions) with magnetic material.

Figure 6:
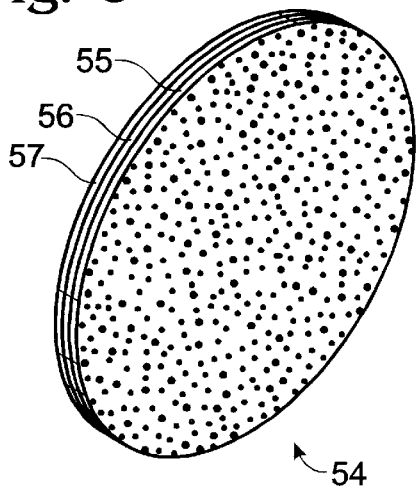
FIGS. 6–7 are a perspective view and a plan view, respectively, of an abrasive article having magnetic material in accordance with the present invention.
Figure 7:
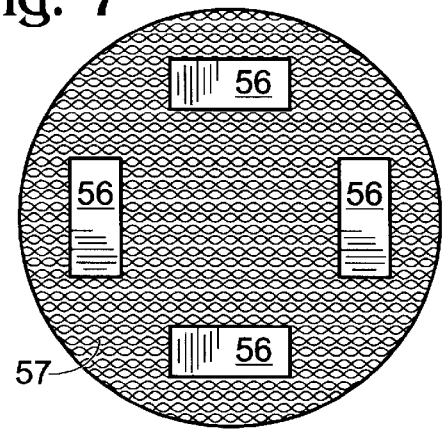

Referring to FIGS. 6–7, a perspective view and a plan view of an abrasive article 54 having magnetic mounting properties in accordance with the present invention are respectively shown. While adapters were shown in FIGS. 3–5, FIGS. 6–7 illustrate abrasive articles, such as sand paper and the like.

FIG. 6 illustrates an article that includes an abrasive face 55 affixed to a magnetic sheet 56, and a an article mounting face 57 affixed to the other side of the magnetic sheet 56. The mounting face 57 may be hook or loop or adhesive or other, or have no positive retention mechanism. The thickness of article 54 is exaggerated to show the component layers.

Alternatively, the magnetic material may be otherwise arranged in the abrasive article. For example, the material may be centrally located in the article as it was in the adapter of FIG. 4 or distributed about the article as shown in FIG. 7. The article of FIG. 7 could be fabricated by removing sections of the mounting face (i.e., backing material) 57 and replacing those sections with flexible magnetic material. FIG. 7 is intended to illustrate a hook or loop type mounting face.

Inclusion of magnetic material 56 in an abrasive article 54 provides a releaseably attachable abrasive article that can be more easily arranged about a repair person and is more resistant to fouling, particularly when provided with non-adhesive backing.

Figure 8:
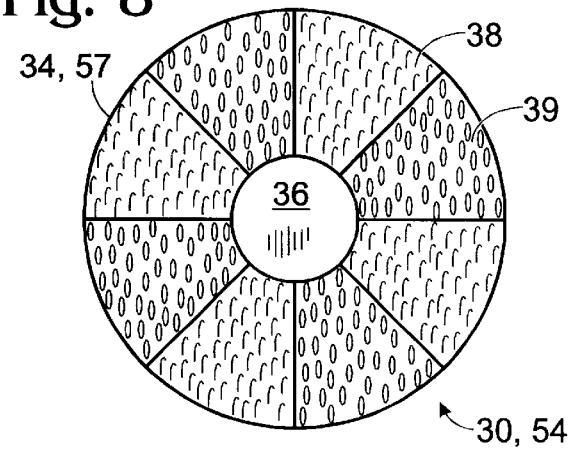
FIGS. 8–9 are plan views of two other abrading adapters (or abrasive articles) in accordance with the present invention.
Figure 9:
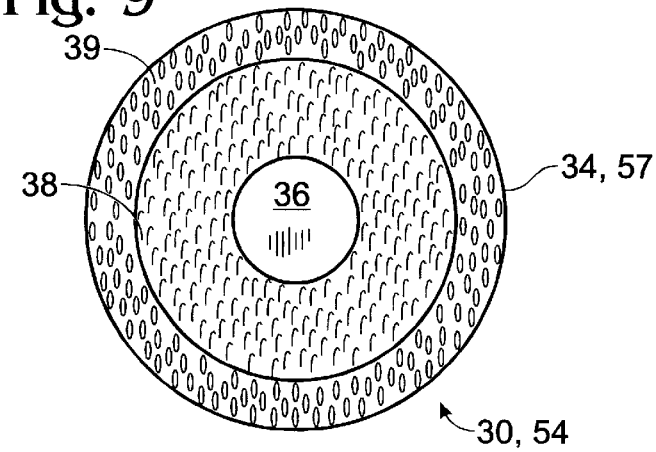

Referring to FIGS. 8 and 9, plan views of two other adapters (or abrasive articles) in accordance with the present invention are shown. The adapter embodiments are discussed first. FIGS. 8 and 9 illustrate the hook and loop or like face 34 of the adapter 30 (similar to the perspective of FIG. 4). In contrast to the embodiment of FIG. 4 in which face 34 is substantially all hook or loop, the embodiment of FIGS. 8 and 9 provide both hook and loop sections 38,39. In FIG. 8, sections 38 and 39 are provided in alternating one-eighth sections. In FIG. 9, sections 38 and 39 are provided as concentric circles. Sections 38 and 39 may be provided in different configurations than those shown without departing from the present invention. The provision of both of these complementary materials on the same surface and in a substantially balanced manner permits adapter 30 to be used with a pad 12 of either type.

The adapters of FIGS. 8 and 9 may optionally be provided with magnetic material 36 as discussed above.

It should also be recognized that the mounting face 57 of the abrasive articles 54 of FIGS. 6 and 7 could be provided with both hook and loop (or like) surfaces. These abrasive articles may optionally include magnetic material as discussed above.

While circular adapters and abrasive articles are shown in FIGS. 3–9, other shaped adapters and abrasive articles are within the present invention. For example, file board (or other geometry) adapters and abrasive articles may be made in the manner described above for their circular counterparts. File board arrangements, for example, are substantially rectangular and preferably have approximate measurements of 2¾" by 16½".

It should further be recognized that the terms hook and/or loop as used herein are intended to include any hook and/or loop or like arrangement, i.e., attachment that is achieved by mechanical retention. Several improved hook and loop and like arrangements are currently being developed and others are expected to be developed in the future. The hook and loop terminology used herein is intended to cover these arrangements.

With respect to manufacture, in one representative embodiment of a manufactured adapter, face 32 may be formed of vinyl with a polyester back such as nagnihide or equivalent. The magnetic material, discussed in more detail below, may be 0.03" flexible plain magnet or equivalent. The exterior surface of the magnet is preferably sanded prior to adhesive application. The hook and loop like structures may be any available and suitable hook or loop like structures. These various components are approriately arranged and preferably joined with Super 77-N spray adhesive from 3M. After assembly, the adapters are rolled or pressed to promote uniform adhesive penetration and to increase structural integrity.

Abrasive articles are preferably manufactured in a similar manner, adding magnetic material and/or alternate hook and loop structure sections to commercially available abrasive sheets. The magnetic material and/or hook and loop structure sections are appropriately arranged and mounted with adhesive. The final article is then rolled or pressed.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. An adapter for use with automated abrading equipment, comprising:

a first material configured to form a first mounting face of a first type adapted for releasably mounting to automated abrading equipment; and a second material configured to form a second mounting face of a second type that is different from said first type, said second material being coupled to said first material and adapted for releasably mounting to an abrasive article; and magnetic material provided on the same face of said adapter as said first material;

wherein said first and second mounting faces are disposed outwardly and in generally opposite directions from one another.

2. The adapter of claim 1, wherein said first material includes hook or loop like structures.

3. The adapter of claim 2, wherein said second material includes an adhesive containing surface or a complementary substantial smooth surface.

4. The adapter of claim 1, wherein said first material provides non-adhesive releasable mounting to said automated abrading equipment.

5. The adapter of claim 2, wherein said first material includes sections of both said hook and loop like structures.

6. The adapter of claim 5, wherein said sections of hook and loop like structures are provided in at least one of the group of arrangements including alternating radially disposed sections and concentric sections.

7. An adapter for use between an automated device and an article, comprising:

a first surface configured for non-adhesive based releasable attachment; and a second surface configured for adhesive based releasable attachment, said first and second surfaces being disposed at different orientations from one another;

wherein said non-adhesive releasable attachment of said first surface is achieved with a plurality of protrusion members or, one given surface and a plurality of complementary receiving members on another given surface and wherein said first surface includes at least one of a plurality of said protrusion members or a plurality of said complementary receiving members;

said adapter further including magnetic material provided at least in part at said first surface.

8. The adapter of claim 1, wherein said magnetic material is located substantially between said first and second materials.

9. The adapter of claim 7, wherein said protrusion members are releasably retained by said complementary receiving members at least in part by positive displacement.

10. An adapter for use between an automated device and an abrasive article, comprising:

a first surface configured for non-adhesive based releasable attachment; and a second surface configured for adhesive based releasable attachment;

wherein said first and second surfaces are disposed at different orientations from one another and magnetic mounting material is provided at least in part with said first surface.

11. The adapter of claim 10, wherein said first surface is further configured for releasable attachment to an automated device and said second surface is further configured for releasable attachment to an abrasive article.

12. The adapter of claim 11, wherein said first and second surfaces are disposed outwardly and substantially oppositely of one another.

13. The adapter of claim 10, wherein said non-adhesive releasable attachment is mechanical retention attachment.

14. The adapter of claim 13, wherein said first surface includes hook or loop like structures.

15. The adapter of claim 13, wherein said first surface includes hook and loop like structures.

16. The adapter of claim 10, wherein said second surface is configured for releasable receipt of an abrasive article having adhesive material.

17. The adapter of claim 10, wherein said second surface is configured to include adhesive for releasable attachment of an abrasive article.

18. An adapter for use between an automated device and an abrasive article, comprising:

a first surface configured for releasable mechanical retention to an automated device; and a second surface configured for releasable adhesive based retention to an abrasive article;

wherein said first and second surfaces are disposed at different orientations from one another and magnetic mounting material is provided at least in part with said first surface.

19. The adapter of claim 18, wherein said first surface includes at least one of a plurality of protrusion members or a plurality of complementary receiving members for those protrusion members.

20. The adapter of claim 18, wherein said first surface includes hook or loop like structures.

21. The adapter of claim 19, wherein said first surface includes a plurality of said protrusion members or a plurality of said complementary receiving members.

22. The adapter of claim 18, wherein said second surface is configured for releasable receipt of an abrasive article containing adhesive material.

23. The adapter of claim 18, wherein said second surface is configured to include adhesive for releasable attachment of an abrasive article.

24. The adapter of claim 18, wherein said first and second surfaces are disposed substantially oppositely of one another.

* * * * *